US007624900B2

(12) United States Patent
McLaughlin

(10) Patent No.: US 7,624,900 B2
(45) Date of Patent: Dec. 1, 2009

(54) RETRACTABLE MULTI-TIERED LINGERIE HANGER

(76) Inventor: Julie McLaughlin, 15556 Leadwell St., Van Nuys, CA (US) 91406

( * ) Notice: Subject to any disclaimer, the term of this patent is extended or adjusted under 35 U.S.C. 154(b) by 0 days.

(21) Appl. No.: 11/707,837

(22) Filed: Feb. 16, 2007

(65) Prior Publication Data

US 2008/0197161 A1 Aug. 21, 2008

(51) Int. Cl.
*A41D 27/22* (2006.01)

(52) U.S. Cl. ..... 223/85; 223/88; 223/89; 223/94; 248/333

(58) Field of Classification Search ..... 223/85, 223/88, 89, 92, 94, 95, 97; 211/113, 115–119; 248/322, 327, 333, 339; D6/315, 317–319
See application file for complete search history.

(56) References Cited

U.S. PATENT DOCUMENTS 1,551,769 A * 9/1925 Paddington ..... 223/88
1,607,749 A * 11/1926 Rice ..... 223/88
2,127,870 A * 8/1938 Kennedy ..... 223/88
2,271,941 A * 2/1942 Kemmitt ..... 211/118
2,298,491 A * 10/1942 Lamar ..... 223/88
2,395,210 A * 2/1946 Baril et al. ..... 211/89.01
2,469,481 A 5/1949 Snyder
2,514,742 A 7/1950 Burger et al.
2,527,642 A * 10/1950 McWhorter ..... 223/88
2,601,926 A * 7/1952 Speaker et al. ..... 211/113
2,675,130 A * 4/1954 Dore ..... 211/118
3,225,977 A * 12/1965 Gandy ..... 223/95
3,347,428 A * 10/1967 Gauthier ..... 223/98
3,352,430 A * 11/1967 McAtee ..... 211/119
3,784,020 A * 1/1974 Steiner ..... 211/1.3
3,860,154 A * 1/1975 Atkins ..... 223/88
3,870,206 A * 3/1975 Feinberg ..... 223/88
3,935,976 A * 2/1976 Mizrach ..... 223/88
3,951,270 A * 4/1976 Kiss ..... 211/119
4,111,309 A * 9/1978 Henry ..... 211/104
4,253,577 A * 3/1981 Macfarlane ..... 211/118
4,728,016 A * 3/1988 McPhee ..... 223/85
4,932,571 A * 6/1990 Blanchard ..... 223/89
5,029,739 A 7/1991 Blanchard et al.
D321,795 S 11/1991 Winston
D322,894 S 1/1992 Brewer, Jr.
D323,941 S * 2/1992 Schwartz ..... D6/317
5,085,357 A * 2/1992 Chen ..... 223/89
D327,581 S 7/1992 Fildan
5,303,855 A * 4/1994 Veale ..... 223/85
5,429,284 A 7/1995 Kolton et al.
5,480,075 A * 1/1996 Robinson ..... 223/88
5,497,908 A * 3/1996 Cheek et al. ..... 223/74
D369,888 S * 5/1996 Demaray ..... D32/58
5,542,530 A * 8/1996 Freelander ..... 206/292
5,582,334 A 12/1996 Blazer et al.
5,603,438 A * 2/1997 Jugan ..... 223/85
D384,825 S 10/1997 Hooworth (Continued)

*Primary Examiner*—Gary L Welch
*Assistant Examiner*—Nathan E Durham
(74) *Attorney, Agent, or Firm*—Edwin Tarver; Lauson & Tarver LLP

(57) ABSTRACT

A multi-tiered hanger for holding multiple undergarments or lingerie. The hanger comprises at least two frames connected together to form a three-dimensional structure, and a hook about which the three-dimensional structure is supported. Each of the at least two frames comprises a means for receiving multiple lingerie.

3 Claims, 9 Drawing Sheets

U.S. PATENT DOCUMENTS 5,911,396 A * 6/1999 Bireley ..... 248/340
6,000,587 A * 12/1999 Sackett et al. ..... 223/85
6,070,773 A 6/2000 Pogoda
6,454,145 B1 * 9/2002 Russ ..... 223/85
6,722,538 B1 * 4/2004 Autry et al. ..... 223/94

* cited by examiner

RETRACTABLE MULTI-TIERED LINGERIE HANGER

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to garment hangers, and more particularly to a retractable multi-tiered hanger for holding multiple lingerie.

Garment hangers are used to conveniently store and organize garments, and a variety of garment hangers have been developed in the art. These hangers generally include a hook and a main body connected to the hook. Some of these hangers are designed for supporting a single garment while others support multiple garments. For example, U.S. Pat. No. 2,514,742 to Burger discloses a multiple garment hanger, which comprises a flat base member and a hook member connected to an upper terminal of the flat base member. The side and bottom edges of the flat base member include a plurality of projections having slots or notches. The slots are spaced parallel to the longitudinal axis of the hanger. The garments are hung in a stepped fashion inwardly and downwardly towards the hanger body.

U.S. Pat. No. 5,582,334 to Blazer discloses a multi-garment, insect infestation inhibiting hanger device for use on a clothes bar. The device comprises a main body that is engaged to a hook. The main body is formed from a section of cut incense cedar or other similarly suitable moth and other insect inhibiting wood. The main body includes a downwardly and inwardly tapering main section and a plurality of garment receiving structures with slots. The device is configured to receive either a plurality of hangers or garment hanging loops.

U.S. Pat. No. 2,469,481 to Snyder discloses a garment hanger, which comprises a supporting member, a pair of spaced side pieces mounted on the opposite sides of the supporting member and clamping members carried by the side pieces. The side pieces decrease in width from top to bottom to provide inwardly offset edge portions, each carrying two clamps. Spring members are used to achieve clamping action.

Although the above hangers are designed to support multiple garments, they differ from the multi-tiered structure of the present invention, which is specifically designed for lingerie.

U.S. Pat. No. 6,070,773 to Pogoda discloses a lingerie hanger comprising a vertical rod, a hook disposed on top of the vertical rod and a plurality of horizontal crossbars attached to the vertical rod along its length. Both the ends of each horizontal crossbar are curved upwards a short distance and back a longer distance toward the vertical rod. Although this lingerie hanger comprises a multi-tiered structure, the present invention improves the art, providing a three-dimensional multi-tiered hanger specially designed to hang and organize lingerie and other undergarments.

Lingerie and other garments are frequently stored in drawers, where they are arranged in piles. It is difficult to find a particular undergarment in a pile of lingerie stored in the drawer. In addition, the types of fabric used to make most lingerie makes it difficult to fold and store. Therefore, it is an object of the present invention to provide a hanger that is specially designed for lingerie.

A further object is to provide a lingerie hanger that comprises a three-dimensional multi-tiered structure.

A further object is to provide a lingerie hanger that can accommodate multiple undergarments.

A further object is to provide a lingerie hanger that can be retracted for storage.

A further object is to provide a lingerie hanger that can be rotated about a vertical axis which makes it easy to place as well as retrieve the undergarments.

Finally, it is an object of the present invention to provide a lingerie hanger that is convenient to store and retrieve lingerie and can be hung in a closet or a wardrobe to a clothes bar. These and other objects of the present invention will become better understood with reference to the appended Summary, Description, and Claims.

SUMMARY

The present invention is a retractable multi-tiered multiple lingerie hanger. The hanger is a three-dimensional structure comprising a hook and two frames. Each frame is defined by a pair of telescopically-retractable vertical tubes connected by a plurality of horizontal bars. The vertical tubes enable the hanger to retract vertically when not in use. Each horizontal bar includes a plurality of upward projections adapted to receive lingerie. The front and rear frames are connected by a plurality of connecting members to form a substantially cuboidal structure. The hook is located above and at the central point between the first and second frames. The hook can also be collapsed downward when not in use.

FIGURES—REFERENCE NUMERALS

Figure 1:
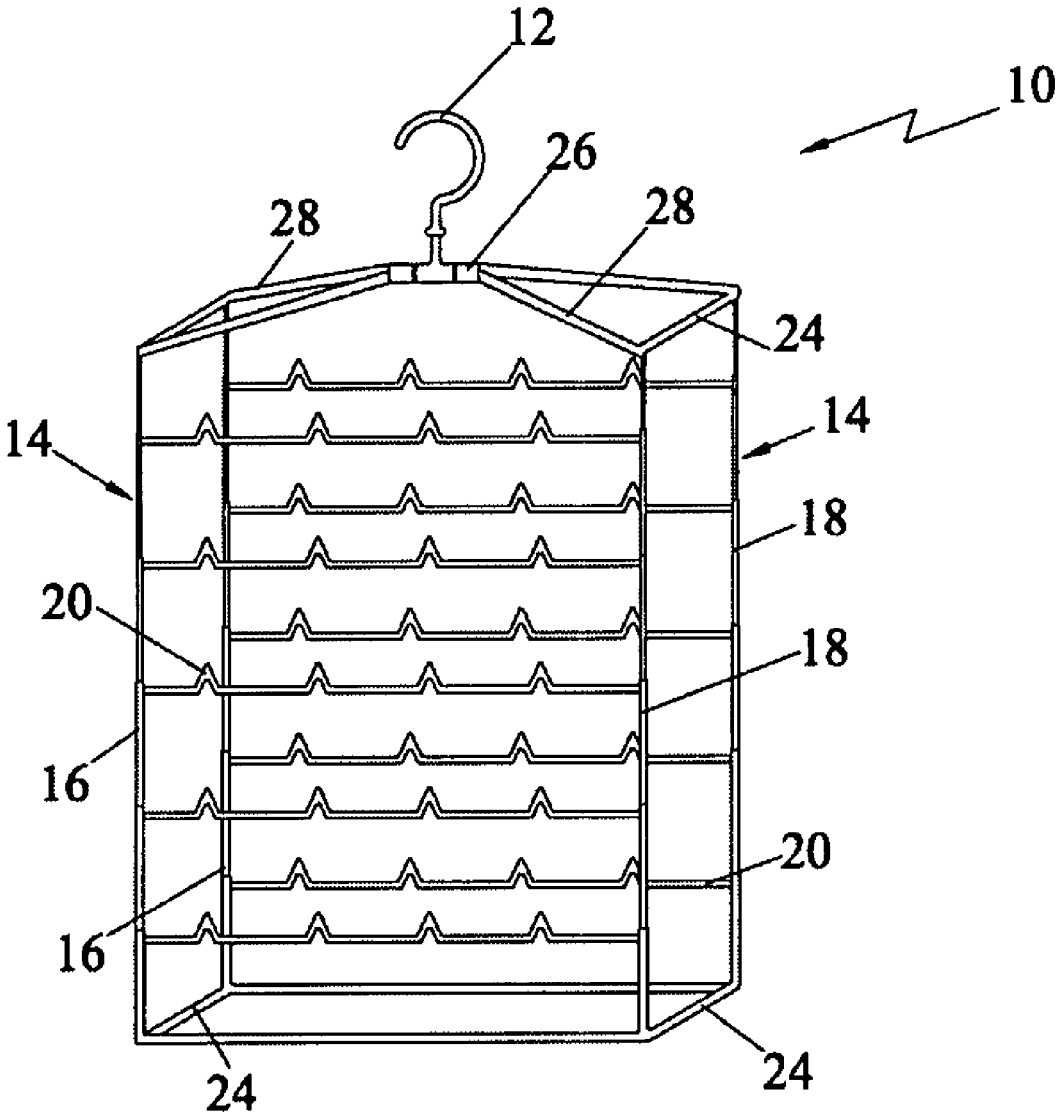
FIG. 1 is a perspective view of the retractable multi-tiered lingerie hanger in accordance with the present invention.
Figure 2:
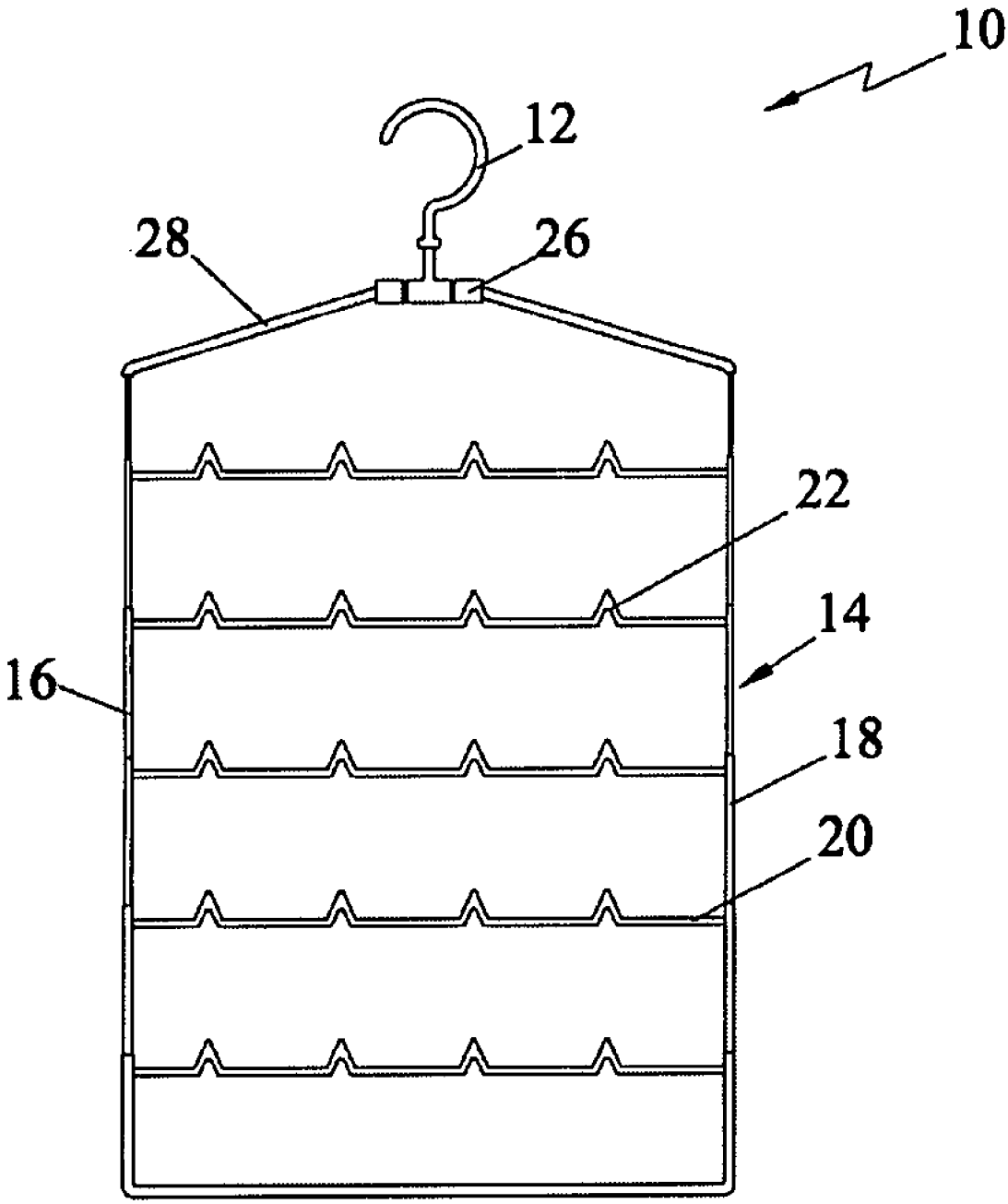
FIG. 2 is a front view of the lingerie hanger in accordance with the present invention.
Figure 3:
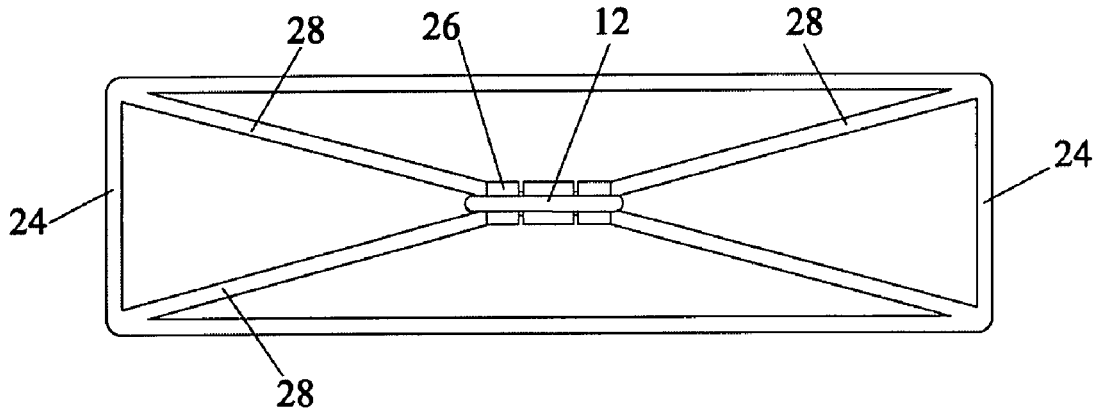
FIG. 3 is a top view of the lingerie hanger in accordance with the present invention.
Figure 4:
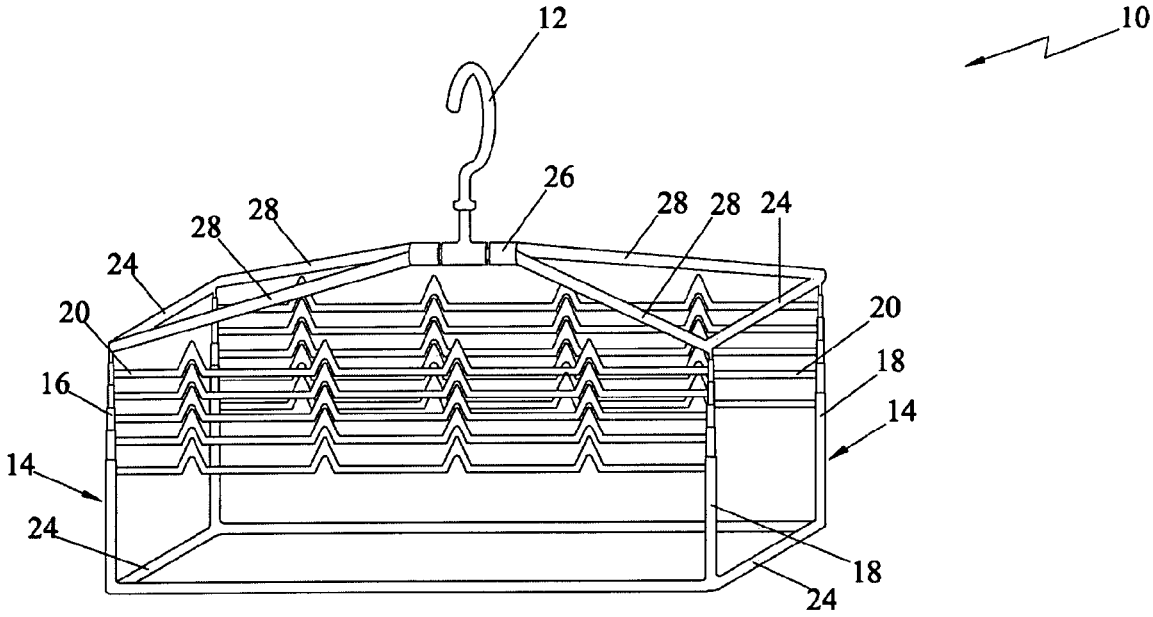
FIG. 4 is a perspective view of the lingerie hanger with the frames collapsed in accordance with the present invention.

10 . . . Retractable Multi-tiered Lingerie Hanger
12 . . . Collapsible Hook
14 . . . Frame
16 . . . First Telescopically-retractable Vertical Tube
18 . . . Second Telescopic-retractable Vertical Tube
20 . . . Horizontal Bar
22 . . . Upward Projection
24 . . . Connecting Bar
26 . . . Horizontal Member
28 . . . Connecting Member
30 . . . End Portion
32 . . . Central Portion
34 . . . Tubular Member
36 . . . Vertical Axis
38 . . . Clothes Bar

DETAILED DESCRIPTION

Referring to the drawings, the preferred embodiment of a retractable multi-tiered lingerie hanger is illustrated and generally indicated as 10 in FIGS.1 through 9. The hanger 10 is a three dimensional structure comprising a collapsible hook 12 and two identical frames 14, namely, a first and second, both connected together by maintaining a parallel and spaced apart relationship.

Referring to FIGS. 1 through 4, each frame 14 is defined by a first telescopically-retractable vertical tube 16, a second telescopically-retractable vertical tube 18 and a plurality of horizontal bars 20 connecting the first and second vertical tubes 16 & 18. Each horizontal bar 20 includes a plurality of upward projections 22, each adapted to receive lingerie. The upward projections 22 are covered with soft materials such as velvet. The horizontal bars 20 connecting the bottom ends of the vertical tubes 16 & 18 and may include upward projections 22. The ends of the first vertical tubes 16 and the ends of the second vertical tubes 18 of the first and second frames 14 are connected by four connecting bars 24, forming a substantially cuboidal structure. When not in use, the tubes 16 & 18 enable the hanger 10 to be telescopically collapsed for easy storage purposes.

Again referring to FIG. 1, the hook 10 is connected to a horizontal member 26, which in turn is connected to the top ends of the vertical tubes 16.& 18 by four connecting members 28. The horizontal member 26, which is of a circular cross-section, is located above the first and second frames 14, and at the central point between the first and second frames 14. The connecting members 28 are slanted downwardly from the extremities of the horizontal member 26 toward the top ends of the vertical tubes 16 & 18.

Figure 5:
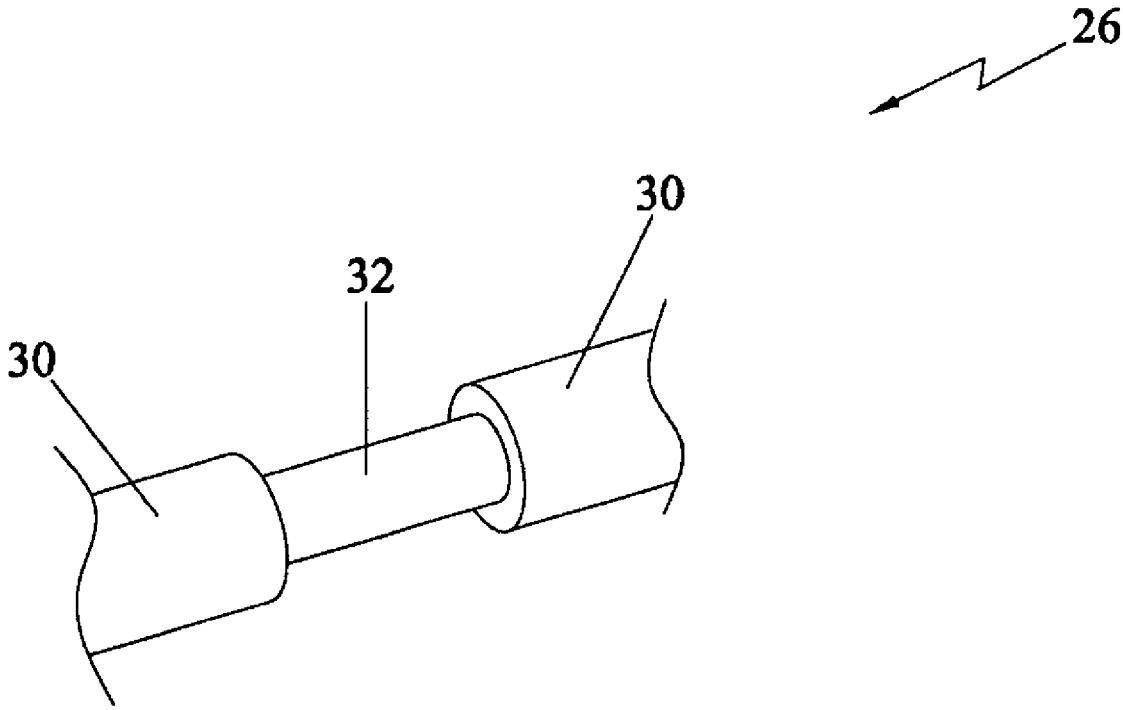
FIG. 5 is a perspective view of the horizontal member in accordance with the present invention.

Referring to FIG. 5, the horizontal member 26 can be divided into two end portions 30 and a central portion 32; the three portions 30 & 32 being coaxial. The central portion 32 of the horizontal member 26 has a cross-sectional area lesser than that of the end portions 30.

Figure 6:
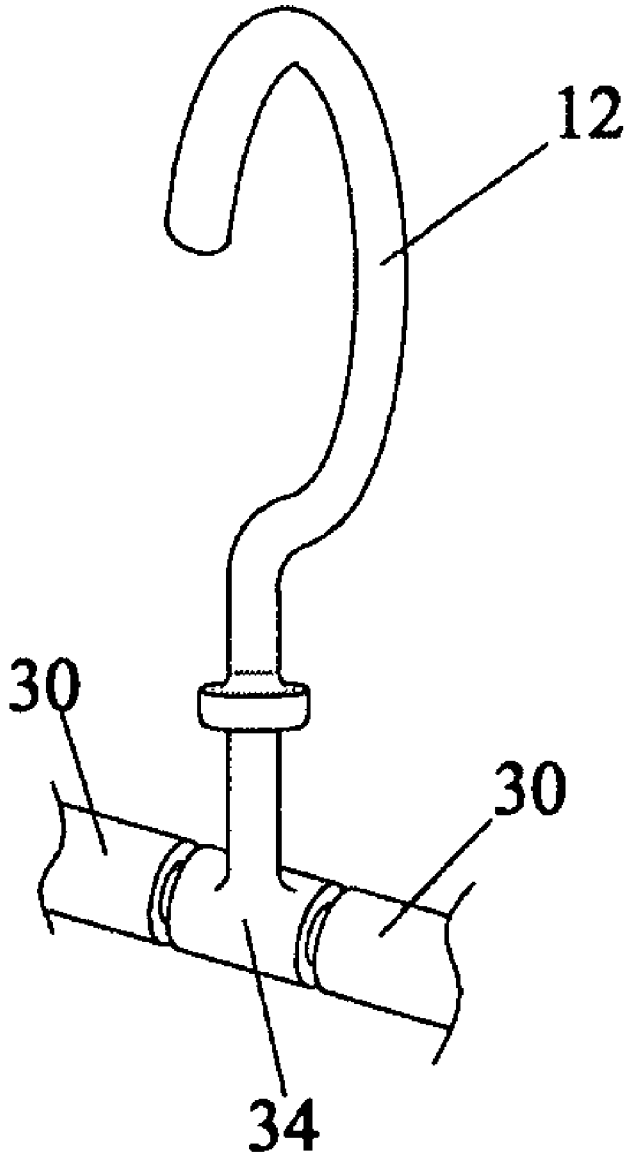
FIG. 6 is a perspective view depicting the hook and the horizontal member connected together in accordance with the present invention.
Figure 7:
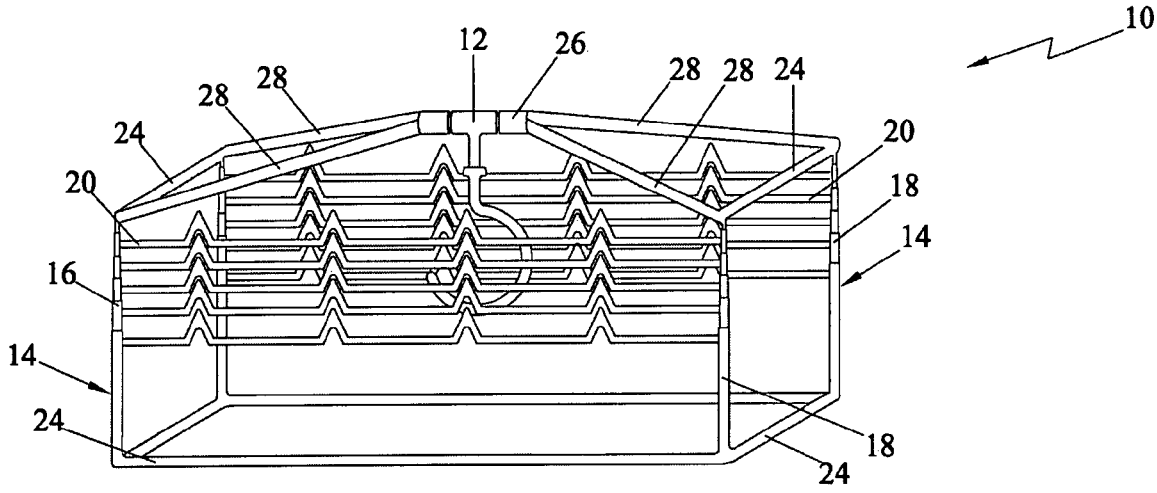
FIG. 7 is a perspective view of the lingerie hanger in totally collapsed position in accordance with the present invention.

Referring to FIGS. 5 through 7, the bottom of the hook 12 is perpendicularly attached to a tubular member 34, which is adapted to receive the central portion 32 of the horizontal member 26. When the central portion 32 is received, the surface of the tubular member 34 becomes flush with the surface of the end portions 30 of the horizontal member 26. This configuration enables the hook 12 to collapse downwardly when not being used as seen in FIG. 7.

Figure 8:
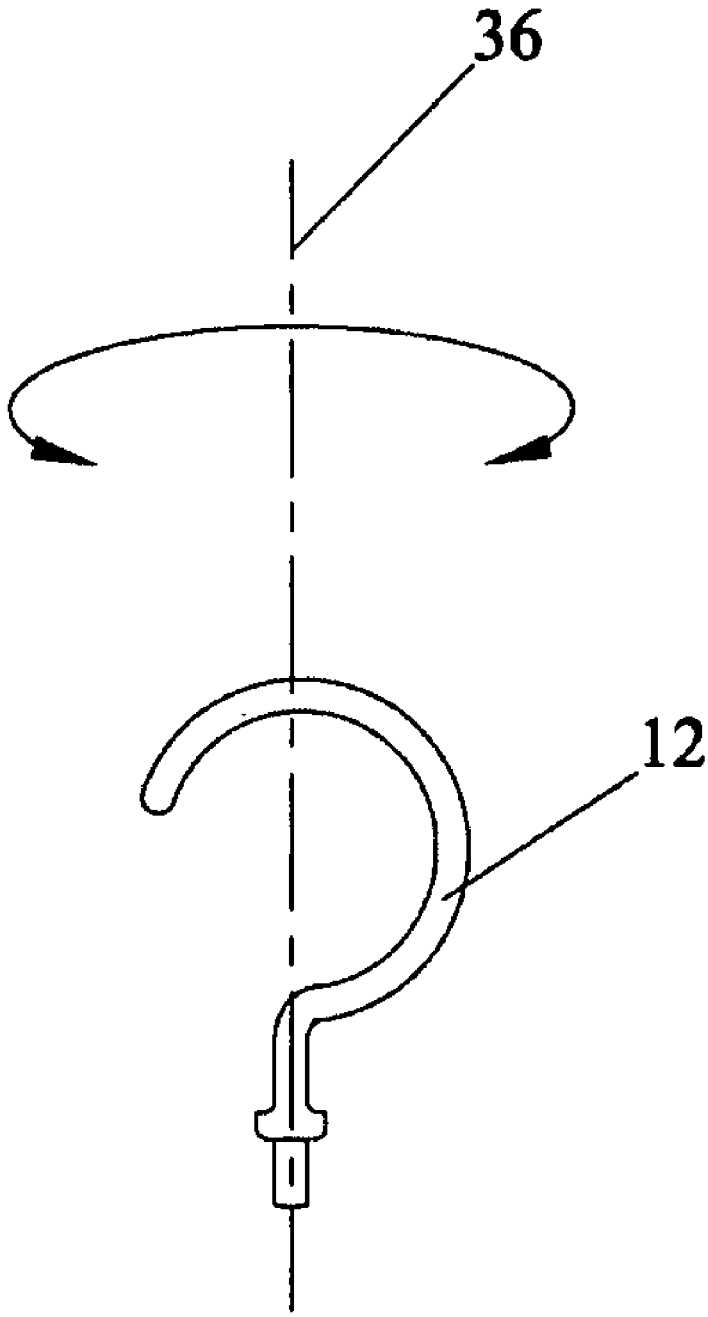
FIG. 8 is a perspective view of the hook in accordance with the present invention.
Figure 9:
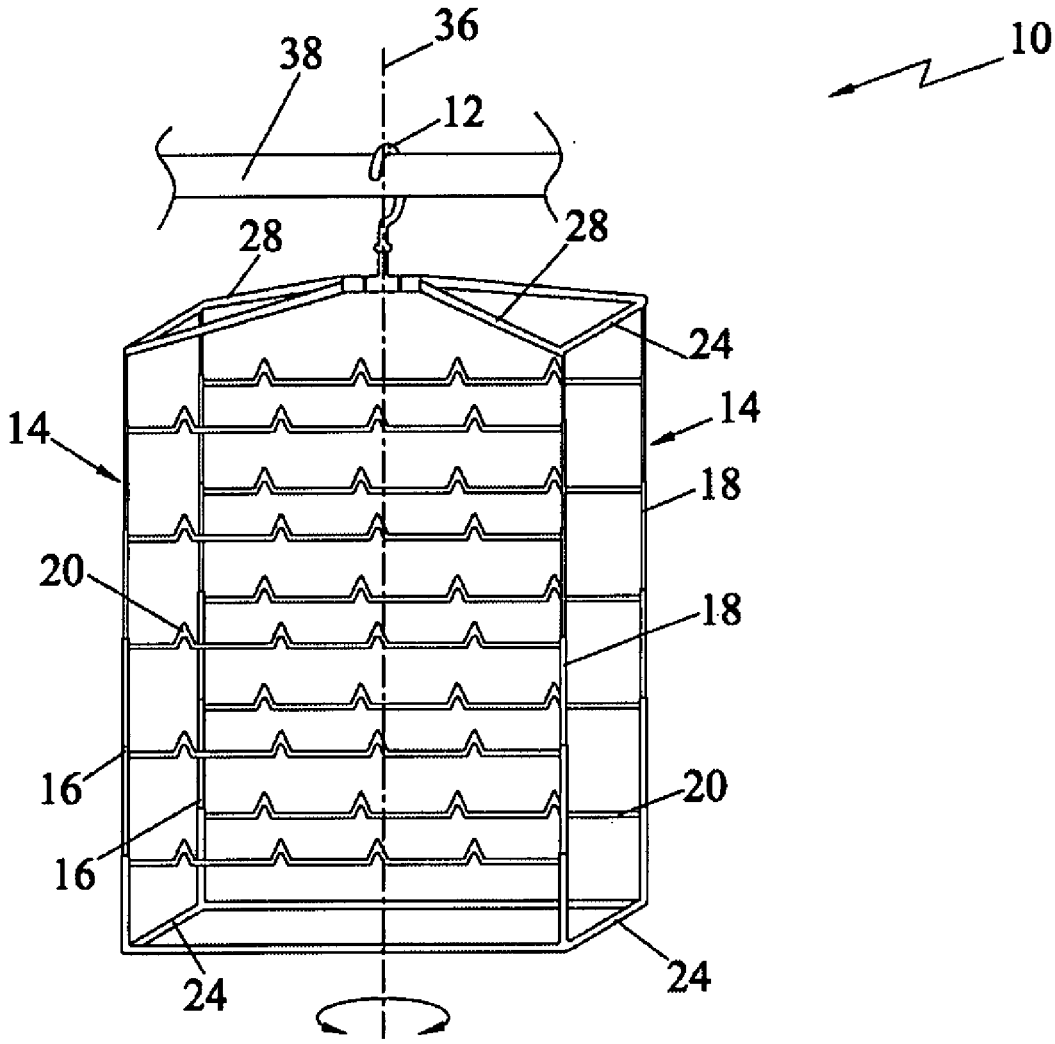
FIG. 9 is a perspective view of the lingerie hanger hooked onto a clothes bar in accordance with the present invention.

Referring to FIGS. 8 and 9, the hook 12 is configured such that it can rotate about a vertical axis 36, thus enabling the hanger 10 to rotate when hooked onto a rod or a clothes bar 38. This arrangement of the hook 12 makes it easy to retrieve the lingerie that is hooked on the backside frame 14 just by rotating the hanger 10.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A multi-tiered lingerie hanger comprising:

(a) at least two frames with vertical members connected by connecting members disposed at a 90 degree angle from the vertical members to form a box-like structure, wherein each of the at least two frames comprises a plurality of horizontal bars connecting its vertical members, wherein the horizontal bars comprise upward projections disposed along their lengths;

(b) a collapsible hook on which the three-dimensional structure is supported;

(c) wherein each of the at least two frames comprises a means of telescoping the vertical members of the frames, so as to increase or decrease the frame height; and (d) wherein each of the at least two frames comprises a pair of telescoping vertical members, the pair of vertical members connected by a plurality of horizontal members, wherein each horizontal member comprises a plurality of projections directed upward forming an inverted "V" shape; the plurality of projections comprising the means for receiving and retaining the lingerie.

2. The lingerie hanger of claim 1, wherein each projection is covered with a soft material, including velvet.

3. The lingerie hanger of claim 1, wherein each horizontal member is perpendicular to the vertical members of the at least two frames.

* * * * *